United States Patent [19]

Spiess

[11] Patent Number: 5,050,500

[45] Date of Patent: Sep. 24, 1991

[54] SHEET TRANSFER WEB

[75] Inventor: Wolfgang C. J. Spiess, Würzburg, Fed. Rep. of Germany

[73] Assignee: Koenig & Bauer Aktiengesellschaft, Würzburg, Fed. Rep. of Germany

[21] Appl. No.: 562,850

[22] Filed: Aug. 6, 1990

[30] Foreign Application Priority Data

Sep. 2, 1989 [DE] Fed. Rep. of Germany ..... 3929228

[51] Int. Cl.[5] ..... B41F 21/00

[52] U.S. Cl. ..... 101/420; 226/199; 271/275

[58] Field of Search ..... 101/409, 418–421; 226/199; 271/275

[56] References Cited

U.S. PATENT DOCUMENTS

| | | | |
|---|---|---|---|
| 2,730,950 | 1/1956 | Grassi | 101/420 |
| 3,334,892 | 8/1967 | Janecek et al. | 101/420 |
| 3,602,140 | 8/1971 | Sudduth | 101/420 |
| 3,642,274 | 2/1972 | Herrington et al. | 101/420 |
| 3,643,598 | 2/1972 | Papa et al. | 101/420 |
| 3,690,648 | 9/1972 | Herrington et al. | 101/420 |
| 3,780,925 | 12/1973 | Ternes | 101/420 |
| 4,242,959 | 1/1981 | Jeschke et al. | 101/420 |
| 4,735,142 | 4/1988 | Haupenthal | 101/420 |

FOREIGN PATENT DOCUMENTS

| | | | |
|---|---|---|---|
| 1179559 | 7/1961 | Fed. Rep. of Germany . | |
| 1891447 | 2/1968 | Fed. Rep. of Germany . | |
| 2813136 | 6/1978 | Fed. Rep. of Germany . | |
| 972487 | 10/1964 | United Kingdom | 101/420 |

*Primary Examiner*—Eugene H. Eickholt

*Attorney, Agent, or Firm*—Jones, Tullar & Cooper

[57] ABSTRACT

A sheet transfer drum for a rotary printing machine utilizes a plurality of sheet carrying segments which are axially adjustably positioned along a rotatable shaft. Each sheet carrying segment uses an upper bow and a lower bow with each bow, in turn, carrying a plurality of spaced sheet supporting elements. One of the sheet carrying bows is pivotable to actuate a cam-like fast acting closure or latch used to secure each sheet carrying segment to the shaft.

7 Claims, 4 Drawing Sheets

SHEET TRANSFER WEB

FIELD OF THE INVENTION

The present invention is directed generally to a sheet transfer drum. More particularly, the present invention is directed to a sheet transfer drum for a multi-color rotary printing machine. Most specifically, the present invention is directed to a sheet transfer drum having axially slidable sheet carrying segments. Each of these sheet carrying segments includes two oppositely radially extending sheet supporting bows. These bows are supported by and are attached to a shaft encircling two part clamp. One of the bows is mounted in a quick release cam-like latch. By moving the top of the bow in an axial direction, the shaft encircling clamp is loosened and can be slid axially along the shaft of the sheet transfer drum, to change the position of the sheet carrying segment.

DESCRIPTION OF THE PRIOR ART

Sheet transfer drums are generally well known in the art and provide assemblies which are useable to transfer printed sheets from one component to another in a rotary printing machine. A typical prior art sheet transfer drum is essentially a hollow cylinder having a solid periphery about which the sheet is transported by suitable endless chains or bands.

A prior art sheet transfer drum is shown in German patent specification No. 2,813,136. This sheet transfer drum has a solid peripheral surface which supports a plurality of elongated elastic tapes or bands. These elastic tapes have a plurality of sheet gripping members threaded onto them. The solid periphery of this sheet transfer drum and of other generally similar sheet transfer drums is the supporting surface for the endless tapes or chains as well as for the sheets themselves that are carried by these endless tapes. Thus the periphery of the sheet transfer drum is significantly larger than the diameter of the support shaft or bearing journals that are used to support the sheet transfer drum. These prior art sheet transfer drums are costly to produce and they have a considerable dead load which has to be carried by the support shaft and bearings.

It will be apparent that a need exists for a sheet transfer drum which will provide proper sheet support and support for the sheet transport belts or bands while having less weight and being adjustable. The sheet transfer drum of the present invention provides such a device and is a substantial improvement over the prior art devices.

SUMMARY OF THE INVENTION

It is an object of the present invention to provide a sheet transfer drum.

Another object of the present invention is to provide a sheet transfer drum for a rotary printing machine.

A further object of the present invention is to provide a sheet transfer drum having a plurality of spaced sheet carrying segments.

Yet another object of the present invention is to provide a sheet transfer drum having axially shiftable sheet carrying segments.

Even a further object of the present invention is to provide a sheet transfer drum having sheet carrying segments which each include spaced sheet support bows.

Still yet another object of the present invention is to provide a sheet transfer drum having a quick release clamp for each sheet carrying segment.

As will be discussed in detail in the description of the preferred embodiment which is set forth subsequently, the sheet transfer drum in accordance with the present invention includes spaced sprocket wheels on either end of a shaft. These sprocket wheels support spaced, endless belts or tapes that have spaced sheet grippers. A plurality of sheet carrying or support segments are spaced axially along the shaft between the two sprocket wheels. Each of these sheet carrying segments includes two diametrically opposing sheet support bows. Each bow pair is carried by a shaft encircling two part housing or clamp. This clamp is axially slidable along the shaft of the sheet transfer drum and can be latched in a desired location by actuation of a cam-like fast acting closure or latch.

The sheet transfer drum of the present invention has several significant advantages over the prior art devices. Since the sheet support capability of the drum is provided by a plurality of spaced sheet carrying segments, instead of by a solid drum periphery, as was the case in the prior art devices, the present device is much lighter in weight. The several axially spaced sheet carrying segments are each quite light weight and thus do not create a heavy rotary mass. This means that lighter weight bearings and journals can also be used. Since the axially spaced sheet carrying or support segments are also axially slidable, the location and surface size of the effective sheet supporting surface provided by the sheet transfer drum of the present invention can also be varied. This provides proper sheet support while allowing the effective sheet support surface size and location to be varied.

A further advantage of the sheet transfer drum of the present invention resides in the cam-like fast acting latch or release assembly for the several sheet support segments. This allows each sheet support segment to be quickly slid along the shaft of the sheet transfer drum without the use of any tools.

The sheet transfer drum of the present invention provides a device which is simple in construction yet effective, which is light weight yet durable and which is easily adjusted without requiring any tools. As such, it is a substantial advance in the art.

BRIEF DESCRIPTION OF THE DRAWINGS 20

While the novel features of the sheet transfer drum in accordance with the present invention are set forth with specificity in the appended claims, a full and complete understanding of the invention may be had by referring to the detailed description of the preferred embodiment, as is set forth subsequently, and as illustrated in the accompanying drawings, in which:

DESCRIPTION OF THE PREFERRED EMBODIMENT

Figure 1:
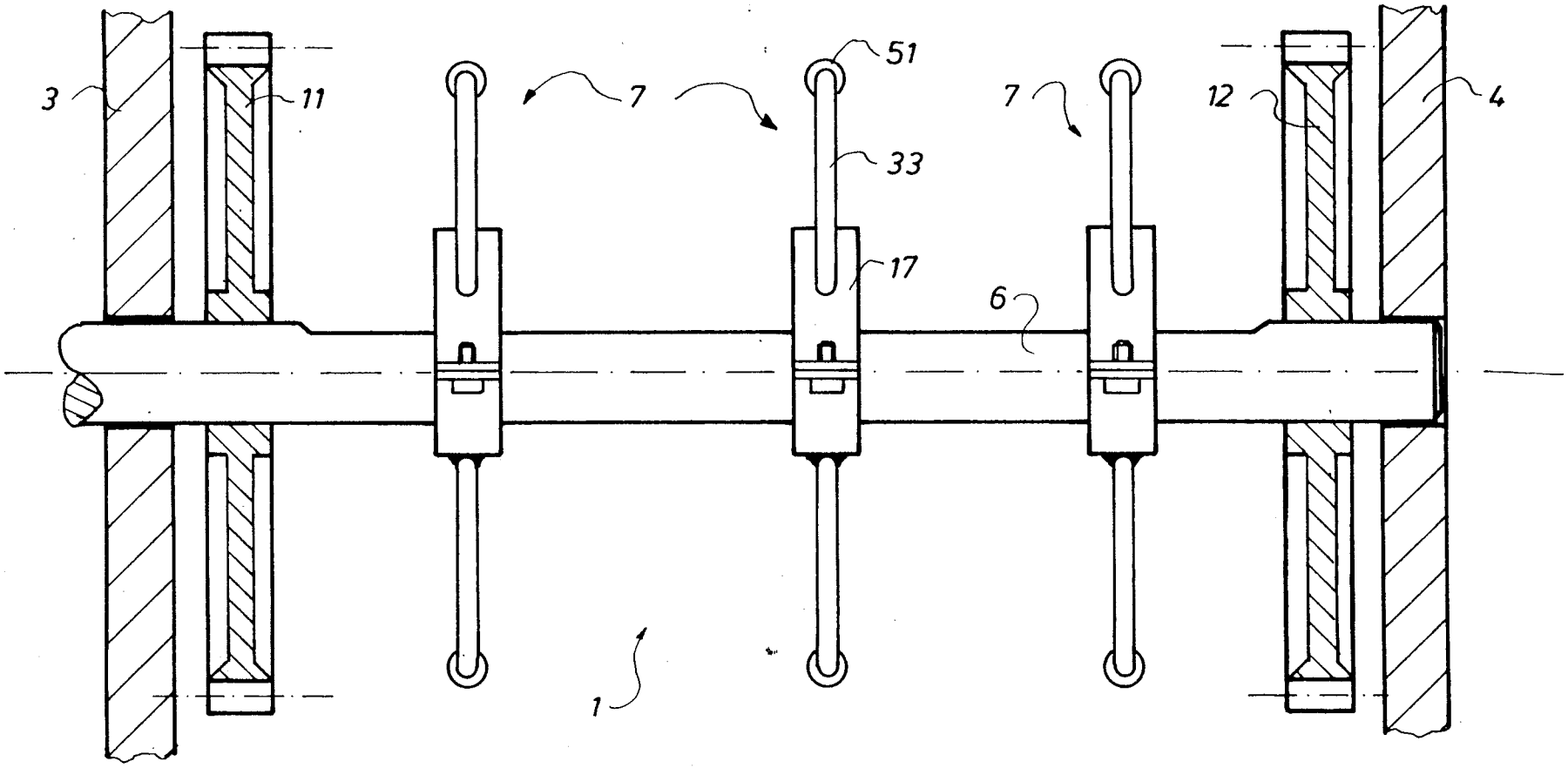
FIG. 1 is a top plan view, partly in section, of the sheet transfer drum of the present invention.
Figure 2:
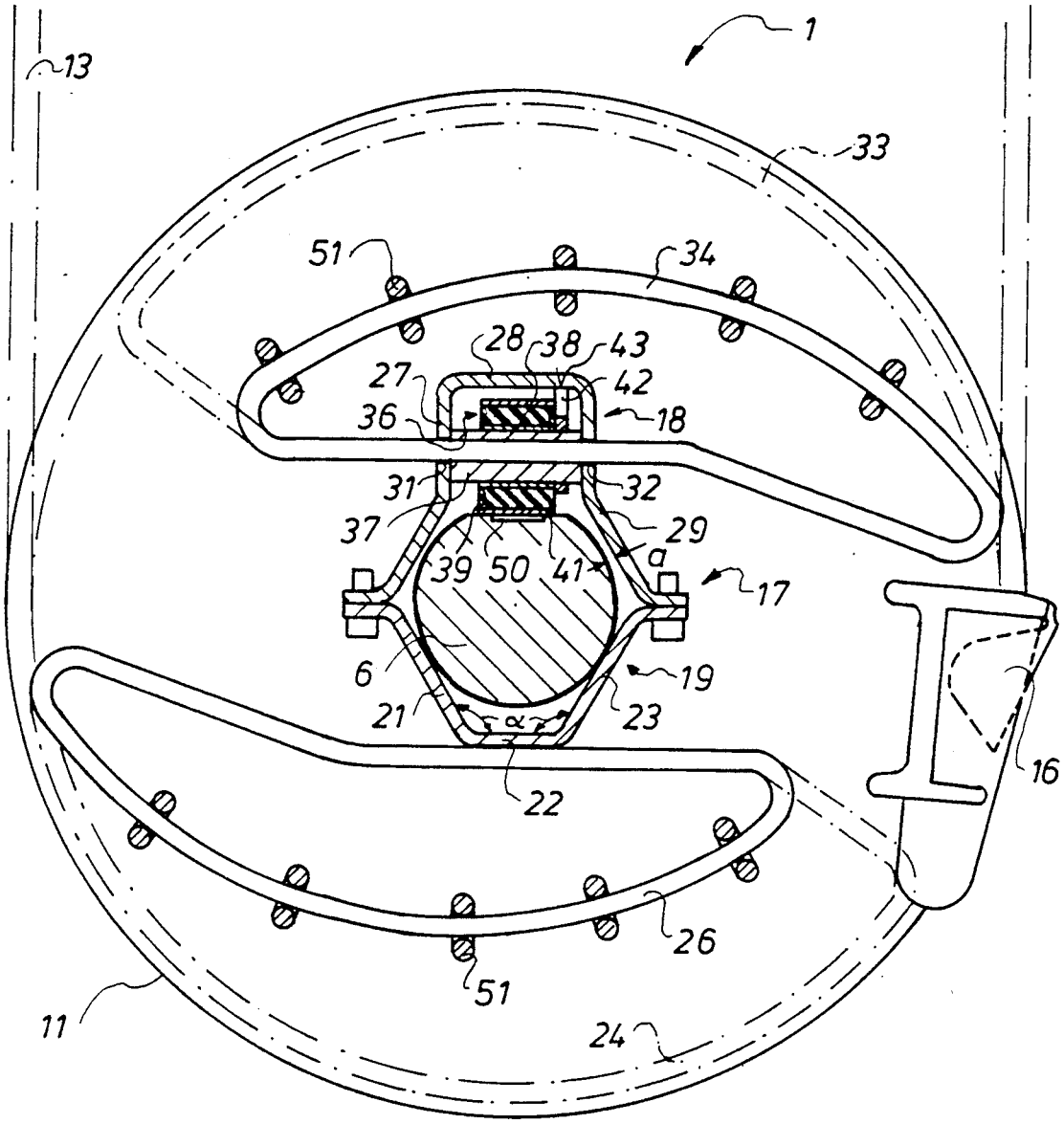
FIG. 2 is a sectional, side elevation view and showing a sheet carrying segment.

Referring initially to FIGS. 1 and 2 there may be seen, generally at 1, a preferred embodiment of a sheet transfer drum in accordance with the present invention. This sheet transfer drum 1 may be used, for example, in the transfer of sheets from a sheet delivery drum in a typical chain delivery system. It will be understood that the sheet transfer drum of the present invention is not to be limited to use with a specific type of sheet delivery or transfer system.

The sheet transfer drum 1 is supported between spaced side frames 3 and 4 of the printing machine's chain delivery system. The sheet transfer drum is essentially comprised of a central, rotatably supported shaft 6, and a plurality of axially spaced sheet carrying segments 7 which are axially shiftably arranged on shaft 6.

At each outer end of the shaft 6 near the inner sides of the side frames 3 and 4, the shaft 6 carries sprocket wheels 11 and 12. The sprocket wheels 11 and 12 are the drive means for endless chains 13 which carry griping devices 16 at spaced distances, as seen in FIG. 2. The transfer drum 1 itself is driven by means of a gear wheel (not shown) which is supported outside of the side frames on the shaft 6.

Each sheet-carrying segment 7, as may be seen in FIG. 2, is supported by a two-part housing or bracket 17 which encompasses the shaft 6. A top part 18 and a bottom part 19 of the housing 17 are detachably connected with each other by bolts or the like. The bottom part 19 has three side walls 21, 22 and 23. Each of these side walls 21, 23 is arranged inclined at a angle $\alpha$, of, for example, 120° towards the side wall 22. In the operating position of the sheet-carrying segments 7, the side walls 21 and 23 contact the shaft 6 in an axially running line contact. The side wall 22 carries a fixed ring-shaped bow 24 fixed to its outside. The bow 24 is aligned in sheet transport direction and has a circumference whose size is pre-determined by the sprocket wheels 11 and 12. This fixed, ring shaped bow 24, which is depicted in FIG. 2 by dot-dash lines, may be exchanged for a similarly shaped but smaller bow 26. This smaller bow 26 is preferred when thin products are being processed whereas the larger ring shaped bow 24 is preferred when a thicker product, such as cardboard is being handled.

The upper or top part 18 of the two part bracket or housing 17 also has three spaced side wall sections 27, 28 and 29. As may be seen in FIG. 2, portions of the two side walls 27 and 29 each has a bearing portion 31 or 32, respectively. These bearing portions 31 and 32 are generally parallel to each other and form supports for upper bows such as a larger upper bow 33 which is shown in dot-dash lines, or a smaller upper bow 34 which is shown in solid lines. Each one of these upper bows 33 and 34 is mounted on two part bracket 17 diametrically opposite its corresponding sized lower bow 24 or 26.

Figure 3:
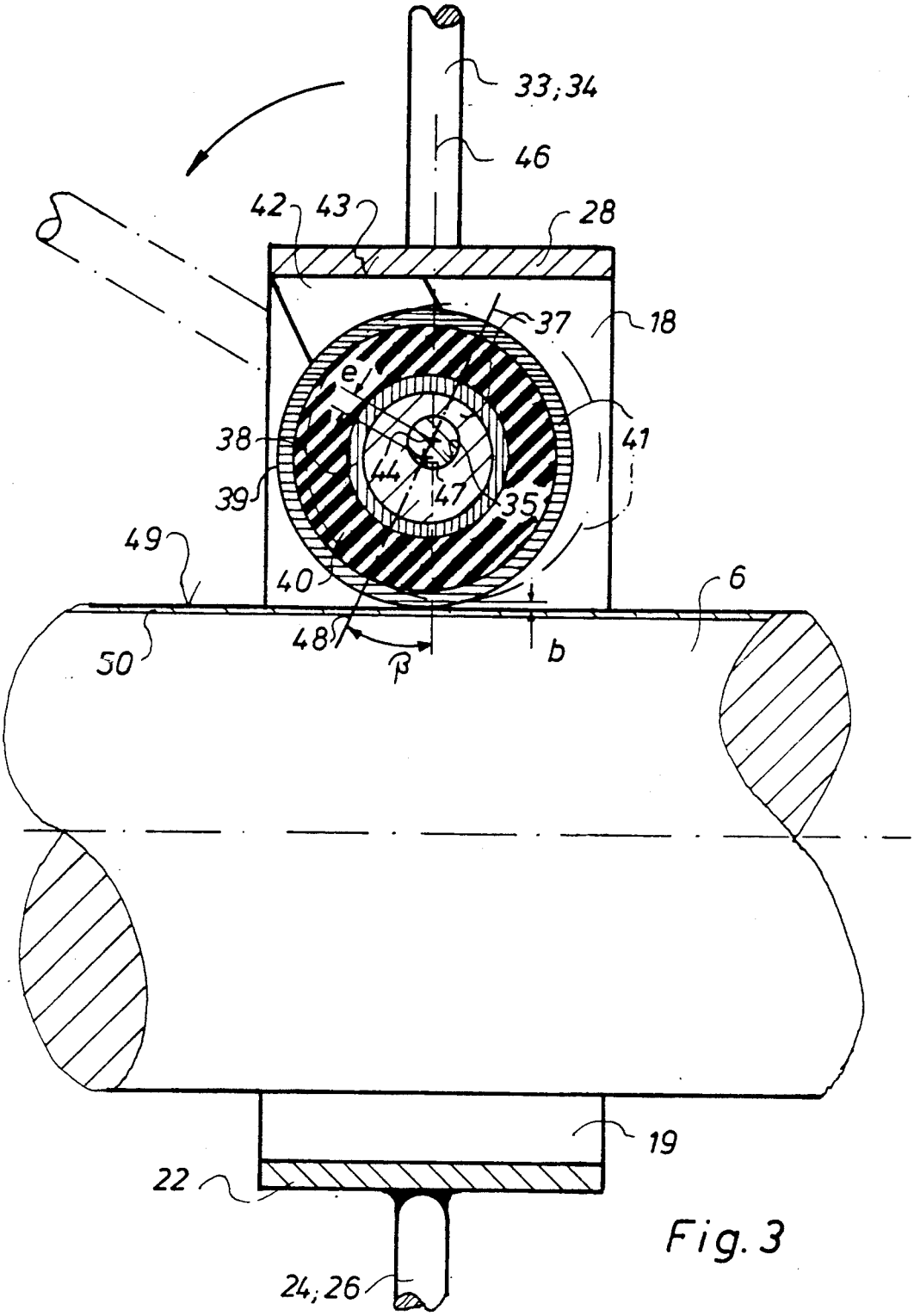
FIG. 3 is a transverse sectional view of one of the fast acting closures or latches for a sheet carrying segment.

As may be seen generally in FIG. 2, and in detail in FIG. 3, each upper bow 33 or 34 is pivotably supported in the bearing portion 31 and 32 of the spaced wall segments 27 and 29 of the upper part 18 of the two part housing or bracket 17. A cam-like fast-acting closure or latch assembly 36 is fixed to the upper bow 33 or 34 within the top part 18 and between the side walls 27 and 29. The fast-acting closure 36 consists of a cylinder 37 with an eccentrically arranged borehole 35 in which the bow 33 or 34 is non-rotatably secured. The cylinder 37 is also non-rotatably situated in an inner ring 38 of a double-walled sleeve 39. Between the inner ring 38 and an outer ring 41 of double walled sleeve 39, a flexible elastic material 40, such as rubber is vulcanized on. Seen in the axial direction of the upper bow 33 or 34, a stop 42 is provided next to the closure or latch 36. This stop 42 is securely attached to the upper bow 33 or 34. The stop 42 has a stop surface 43 which is engagable with the bottom side of the side wall 28 when the bow 33 or 34 is in its operating position and thus insures that the bow 33 or 34 cannot be pivoted farther than the operating position.

A center 44 of the borehole 35 lies on a vertically extending straight line 46 when the upper bow 33 or 34 it is in operating position. A center 47 of the cylinder 37 lies at a distance such as 5 mm from the center 44 and on a straight line 48 which connects the centers 44 and 47 with each other. The straight lines 46 and 48 intersect in the center 44 of an acute angle of generally about 12°.

As may be seen most clearly in FIGS. 2 and 3, the outer ring 41 of closure or latch 36 contacts the surface of a flattened surface 49 of the shaft 6 when in the operating position. A position indicator 50, which can easily be seen by the operating staff and which may be in the form of, for example a measuring stick, is provided on the flattened surface 49 along an adjusting area between the sprocket wheels 11 and 12. By this, the operating staff can read the adjusted position of the sheet-carrying segments 7 directly on the transfer drum 1 so that a portable measuring instrument is not needed.

When a sheet-carrying segment 7 is to be released from its operating position and is to be re-positioned in another operating position, as shown in FIG. 3, the upper bow 33 or 34 is pivoted counter-clockwise. In doing this, the bow 33 or 34 pivots around the center 44 into a released position represented by the dot-dash line. After a rotation of cylinder 37 about an angle $\beta$ the centers 44 and 47 lie together on the straight line 46. In this position the cam or latch 36 is in a "dead center position". This means that the elastic material 40 provided between the inner ring 38 and the outer ring 41 is slightly compressed by which the outer ring 41 is springily pressed on the surface of the flattened surface portion 49 of shaft 6. A further rotation beyond the angle $\beta$ has the effect that the contact between the outer ring 41 and the flat surface 49 is released. The outer ring 41 is thereby pivoted away from the flat 49 until a sufficiently large distance "b" such as 2 mm is reached. This position could also be predetermined by a suitable stop. In practice, the contact between the outer ring 41 and the flat 49 remains while the upper part 18 of the housing 17 is displaced downwardly until a sufficiently large clearance is reached between the shaft 6 and the side walls 21 and 23 so that the two part housing or bracket 17 and its two associated bows 24 or 26 and 33 or 34 can be slid along shaft 6 and relocated as desired.

Figure 4:
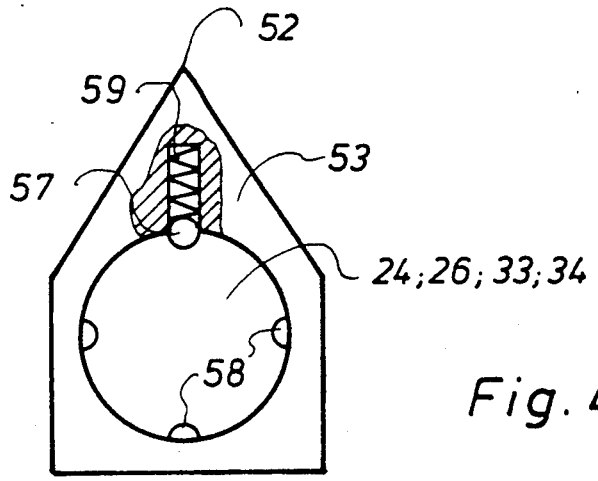
FIGS. 4–6 are detailed views of several embodiments of sheet supporting elements that are carried by the sheet carrying segments.
Figure 5:
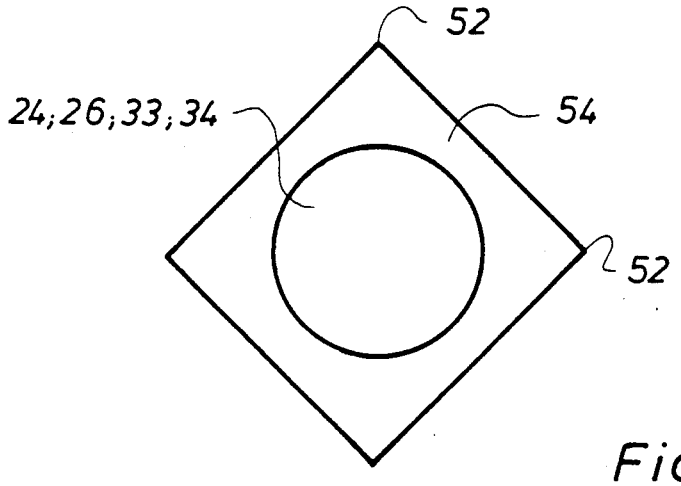
Figure 6:
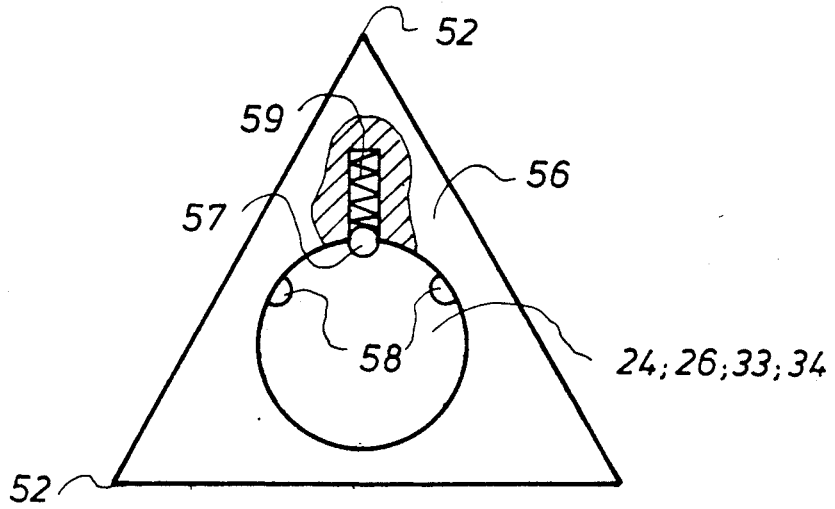

As is shown in FIGS. 1 and 2, the bows 24 or 26 and 33 or 34 are provided with a number of sheet support elements 51 which may be ink-repellant plastic rollers and which are shiftably arranged on bows 24 or 26 and 33 or 34 in the circumferential direction of the transfer drum 1. A transported sheet thus does not lie directly on the sheet-carrying segments 7 but instead on the sheet supporting elements 51. In this way, the supporting of a sheet is accomplished by small dot-shaped surfaces which can be adjusted to engage blank areas of the printed sheet. The sheet supporting elements 51, as shown in FIGS. 1 and 2 are generally annular rollers. As may be seen in FIGS. 4, 5 and 6, these sheet supporting elements 53, 54 or 56 could alternatively be structured having a sheet supporting edge 52 which, if desired, can be moved into or out of engagement with the surface of the sheet. These support elements 53, 54 and 56 depicted in FIGS. 4–6 could be polygonal in cross-sectional shape and could be securely but manually pivotably supported on the bows 24 or 26 and 33 or 34. This will allow the supporting elements 53, 54 or 56 to be pivoted so that their sheet supporting edge 52 may be moved into or out of the area contacted by the transported sheet. Each of the sheet supporting elements 53, 54 or 56 may have one or more balls 57 which are spring biased radially inwardly against the surface of the sheet support bows 24 or 26 and 33 or 34 by a biasing spring 59. Axially extending grooves 58 may be formed on the surface of these bows and the spring biased balls can be received in these grooves. It will be seen that this cooperation will serve to position each such sheet supporting element 53, 54 or 56 in one of several specified portions on the sheet support bow. This will allow the sheet supporting point or edge 52 to be placed either in sheet contacting orientation or in sheet non-contacting orientation.

In the preferred embodiment of the sheet transfer drum 1 disclosed hereinabove, the sheet support bow 33 or 34 is a single element which passes through the cam-like fast acting closure or latch assembly 36. As discussed above, movement of the two part housing or bracket 17 along shaft 6 is effected by pivoting bow 33 or 34. It would also be possible to separate that part of the bow 33 or 34 which passes through the bearing portions 31 and 32 of the side walls 27 and 29 and to provide this separated portion of the sheet support bow 33 or 34 with a separate handle. Concurrently, the remaining portion of the bow 33 or 34 would be securely attached to, for example, the outer surfaces of the side walls 27 and 29, or the outer surface of upper wall 28 of the upper portion 18 of the two part bracket or housing 17. This would allow the two separate tasks of sheet support, and operation of the cam-like fast acting latch 36 to be accomplished by two separate devices.

While a preferred embodiment of a sheet transfer drum in accordance with the present invention has been set forth fully and completely hereinabove, it will be apparent to one of skill in the art that a number of changes in, for example the specific type of endless belts used, the drive means for the sheet transfer drum, the number of sheet carrying segments positioned along the shaft and the like may be made without departing from the true spirit and scope of the present invention which is accordingly to be limited only by the following claims.

What is claimed is:

1. A sheet transfer drum for a rotary printing machine, said sheet transfer drum comprising:

a rotatable shaft;

a plurality of sheet carrying segments, each of said sheet carrying segments being secured to said shaft by a fast-acting closure and being shiftable axially along said rotatable shaft; and a plurality of spaced sheet support elements positioned on each of said sheet carrying segments, each of said sheet support elements being shiftable axially and circumferentially with respect to its one of said sheet carrying segments.

2. The sheet transfer drum of claim 1 wherein said fast-acting closure comprises a cylinder having an eccentrically positioned bore, said cylinder being coaxially supported in an outer ring by a sleeve of flexible, elastic material positioned between said cylinder and said outer ring.

3. The sheet transfer drum of claim 1 wherein said shiftable sheet supporting elements are positioned on sheet supporting bows of said sheet carrying elements.

4. The sheet transfer drum of claim 3 wherein each of said sheet supporting elements has at least one sheet supporting edge.

5. The sheet transfer drum of claim 3 wherein each of said sheet supporting elements is rotatably supported on one of said bows

6. The sheet transfer drum of claim 5 wherein each of said sheet supporting elements has one or more spring biased detent balls in contact with an outer surface of said bow on which said sheet supporting element is carried.

7. The sheet transfer drum of claim 6 wherein said spring biased detent balls are selectively receivable in axially extending grooves on said outer surface of said bow.

* * * * *